US006412322B1

(12) United States Patent
Hyakutake et al.

(10) Patent No.: US 6,412,322 B1
(45) Date of Patent: Jul. 2, 2002

(54) ROLLING METHOD

(75) Inventors: Junji Hyakutake; Isamu Okamura, both of Kurashiki (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/700,022

(22) PCT Filed: Mar. 13, 2000

(86) PCT No.: PCT/JP00/01492

§ 371 (c)(1),
(2), (4) Date: Nov. 9, 2000

(87) PCT Pub. No.: WO00/56476

PCT Pub. Date: Sep. 28, 2000

(30) Foreign Application Priority Data

Mar. 19, 1999 (JP) ..... 11-076748

(51) Int. Cl.[7] ..... B21B 37/72

(52) U.S. Cl. ..... 72/11.5; 72/8.8; 72/229; 72/365.2

(58) Field of Search ..... 72/8.3, 8.4, 8.8, 72/10.3, 11.1, 11.2, 11.5, 12.5, 229, 365.2; 700/151

(56) References Cited

U.S. PATENT DOCUMENTS 5,063,767 A * 11/1991 Drummond ..... 72/8.8
6,216,504 B1 * 4/2001 Kurakakie et al. ..... 72/9.2

FOREIGN PATENT DOCUMENTS

JP 62-26842 * 6/1987 ..... 72/229
JP 63-215313 * 9/1988 ..... 72/12.5
JP 9-57320 * 3/1997 ..... B21B/37/46
JP 9-122732 * 5/1997 ..... B21B/39/12

* cited by examiner

*Primary Examiner*—Ed Tolan
(74) *Attorney, Agent, or Firm*—Oliff & Berridge, PLC

(57) ABSTRACT

In continuous rolling of a plurality of steel strips: 1. a table speed corrector corrects speeds of tables, on which a succeeding steel strip is placed, through a main controller so that values of an interval between steel strips, obtained by CCD cameras before the preceding steel strip is rolled, are set to a first set value preset as an interval so the preceding and succeeding steel strips do not come into collision with each other due to a reduction in speed when the preceding steel strip is caught; 2. the table speed corrector corrects speeds of the tables, on which the succeeding steel strip is placed, through the main controller so that values of an interval between steel strips, obtained by CCD cameras when the preceding steel strip is being rolled, are set to a second value preset as an interval at which the succeeding steel strip is caught by the rolling mill 1 at the same time at which the trailing end of the preceding steel strip has passed therethrough; and 3. the table speed corrector controls speeds of the tables, on which the preceding steel strip is placed, through the main controller so that measured values of an interval between steel strips, obtained by CCD cameras when the succeeding steel strip is being rolled, are set to a third value preset as an optimum value in the next rolling.

5 Claims, 2 Drawing Sheets

ROLLING METHOD

This application is a 35 USC371 of PCT/JP00/01492 filed Mar. 13, 2000.

TECHNICAL FIELD

The present invention relates to a method of continuously rolling a plurality of steel strips while controlling gaps therebetween.

BACKGROUND ART

There has been known a method of improving a rolling efficiency by reducing an interval between steel strips in such a manner that, between a preceding steel strip and a succeeding steel strip in a conventional one-way rolling and between the final path of a preceding steel strip and the first path of a succeeding steel strip in reverse rolling, a position of the trailing end of the preceding steel strip is determined from a rolling speed of the preceding steel strip, a predicted value of a backward ratio and a length of the steel strip as well as a position of the leading end of the succeeding steel strip is determined by a transportation speed of the succeeding steel strip calculated based on values detected by number of rotation detectors mounted on transportation tables and a moving distance of the succeeding steel strip from a leading end detector, an interval between the trailing end of the preceding steel strip which is being rolled and the leading end of the succeeding steel strip is determined from a difference between the thus determined positions is determined and used as a measured value, and speeds of the transportation tables at the inlet side and the outlet side of a rolling mill and a speed of the rolling mill are controlled based on the measured value.

However, when the above method is applied to a rolling method of simultaneously manufacturing a plurality of steel strips by disposing a plurality of the steel strips in a rolling direction and subjecting them to reverse rolling at the same time, measured intervals between the steel strips are greatly different from actual intervals therebetween due to a prediction error of a backward ratio and a variation of the backward ratio during rolling, an error of a rolling speed caused by thermal deformation and wear of rolls, and an error of a transportation speed of a succeeding steel strip and an error of a moving distance of the succeeding steel strip from the leading position detector which are caused by slip between steel strips being transported and the transportation tables. Therefore, there is arisen a drawback that inter-strip control of high accuracy cannot be carried out.

An object of the present invention, which was made to overcome the above drawback, is to provide a rolling method capable of dramatically improving a rolling efficiency by permitting a plurality of steel strips to be subjected not only to one-way rolling but also to reverse rolling at the same time by performing interstrip control of high accuracy.

DISCLOSURE OF INVENTION

To achieve the above object, a rolling method according to claim 1 is characterized in that interval measuring means for directly measuring an actual interval between the trailing end of a preceding steel strip and the leading end of a succeeding steel strip are disposed on the inlet side and the outlet side of a rolling mill, respectively and transportation speeds of the preceding steel strip and the succeeding steel strip are controlled separately from a speed of the rolling mill based on measured values obtained by the interval measuring means on the inlet side and the outlet side.

A rolling method according to claim 2 is characterized in claim 1 in that speeds of inlet side transportation tables for transporting the succeeding steel strip are controlled so that measured values, before the preceding steel strip is caught by the rolling mill, of an interval between the trailing end of the preceding steel strip and the leading end of the succeeding steel strip, which have been obtained by the inlet side interval measuring device, are set to a first set value preset as an interval at which the preceding steel strip does not come into collision with the succeeding steel strip due to a reduction in speed which is caused when the preceding steel strip is caught by the rolling mill, speeds of the inlet side transportation tables for transporting the succeeding steel strip are controlled separately from a speed of the rolling mill so that measured values, when the preceding steel strip is being rolled, of an interval between the trailing end of the preceding steel strip and the leading end of the succeeding steel strip, which have been obtained by the inlet side interval measuring device, are set to a second set value preset as an interval at which the succeeding steel strip is caught by the rolling mill at the same time at which the trailing end of the preceding steel strip has passed through the rolling mill, and speeds of outlet side transportation tables for transporting the preceding steel strip are controlled separately from a speed of the rolling mill so that measured values, when the succeeding steel strip is being rolled, of an interval between the trailing end of the preceding steel strip and the leading end of the succeeding steel strip, which have been obtained by the outlet side interval measuring device, is set to a third set value preset as an optimum interval in rolling in a next process.

A rolling method according to claim 3 for disposing interval measuring means, which directly measures an actual interval between the trailing end of a preceding steel strip and the leading end of a succeeding steel strip, at an inlet side and an outlet side of a rolling mill, respectively and controlling transportation speeds of the preceding steel strip and the succeeding steel strip based on measured values which have been obtained by the interval measuring means at the inlet side and the outlet side is characterized in that speeds of inlet side transportation tables for transporting the succeeding steel strip are controlled so that measured values, before the preceding steel strip is caught by the rolling mill, of an interval between the trailing end of the preceding steel strip and the leading end of the succeeding steel strip, which have been obtained by the inlet side interval measuring device, are set to a first preset value as an interval at which the preceding steel strip doe s not come into collision with the succeeding steel strip due to a reduction in speed which is caused when the preceding steel strip is caught by the rolling mill, speeds of the in let side transportation tables for transporting the succeeding steel strip are comprehensively controlled together with a speed of the rolling mill so that measured values, when the preceding steel strip is being rolled, of an interval between the trailing end of the preceding steel strip and the leading end of the succeeding steel strip, which have been obtained by the inlet side interval measuring device, are set to a second set value preset as an interval at which the succeeding steel strip is caught by the rolling mill at the same time at which the trailing end of the preceding steel strip has passed through the rolling mill, and speeds of outlet side transportation tables for transporting the preceding steel strip are comprehensively controlled together with a speed of the rolling mill so that measured values, when the succeeding steel strip is being rolled, of an interval between the trailing end of the preceding steel strip and the leading end of the succeeding steel strip, which have been obtained by the outlet side interval measuring device, is set to a third set value preset as an optimum interval in rolling in a next process.

BRIEF DESCRIPTION OF THE DRAWINGS

FIG. 1 is a view explaining a rolling method as an example of an embodiment of the present invention.

FIG. 2 is a graph showing a relationship between a rolling time and a rolling load when two steel strips are individually rolled one by one.

FIG. 3 is a graph showing a relationship between a rolling time and a rolling load when two steel strips are continuously rolled using the method of the present invention.

REFERENCE NUMERALS

Figure 1:
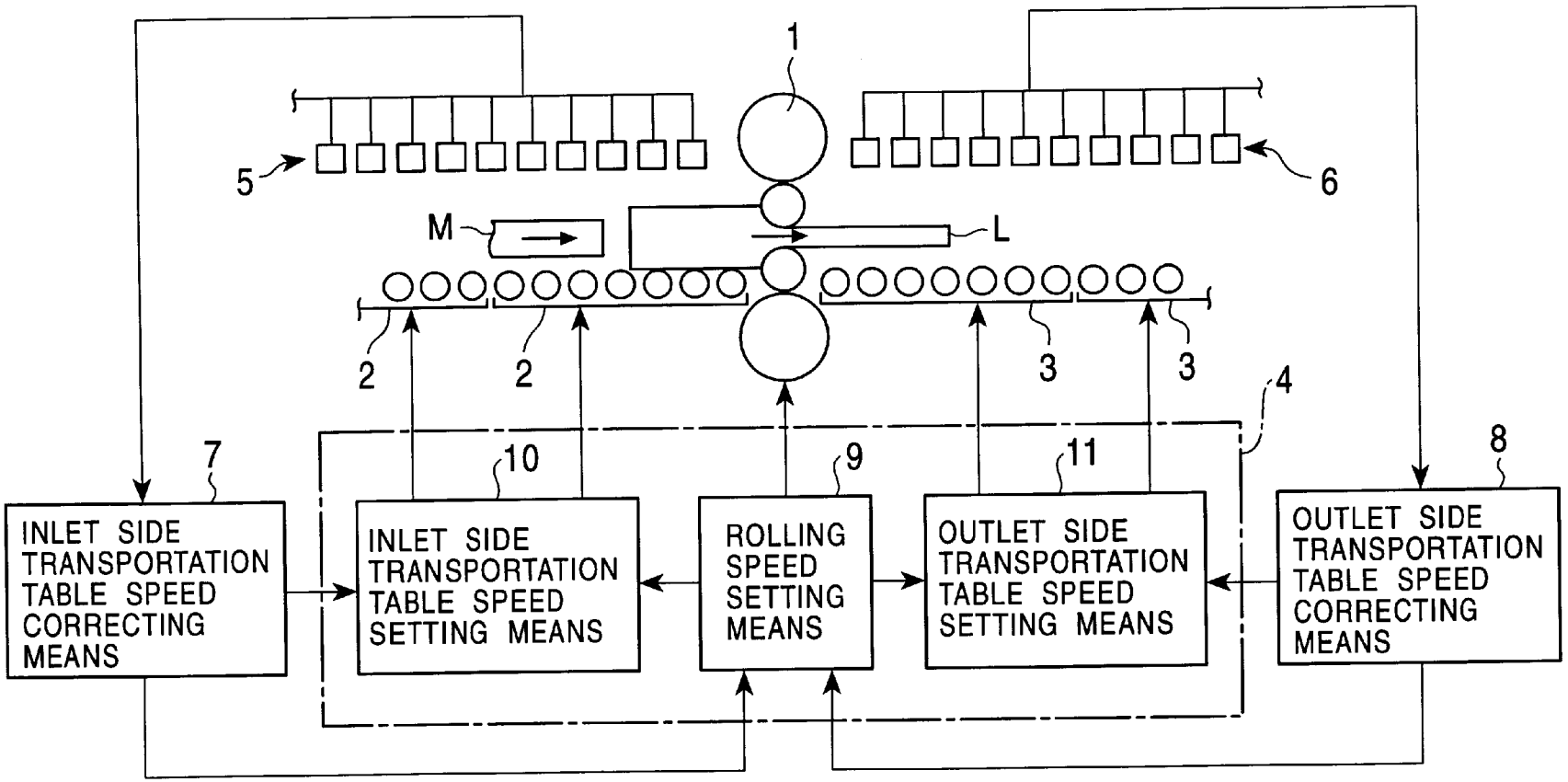
FIG. 1

L, M . . . steel strip

1 . . . rolling mill

2 . . . inlet side transportation table

3 . . . outlet side transportation tables

4 . . . main controller

5 . . . inlet side interval measuring device

6 . . . outlet side interval measuring device

7 . . . inlet side transportation table speed correction means

8 . . . outlet side transportation table speed correcting means

9 . . . rolling speed setting means

10 . . . inlet side transportation table speed setting means

11 . . . outlet side transportation table speed setting means

BEST MODE FOR CARRYING OUT THE INVENTION

An example of an embodiment of the present invention will be described below with reference to the drawings.

Figure 2:
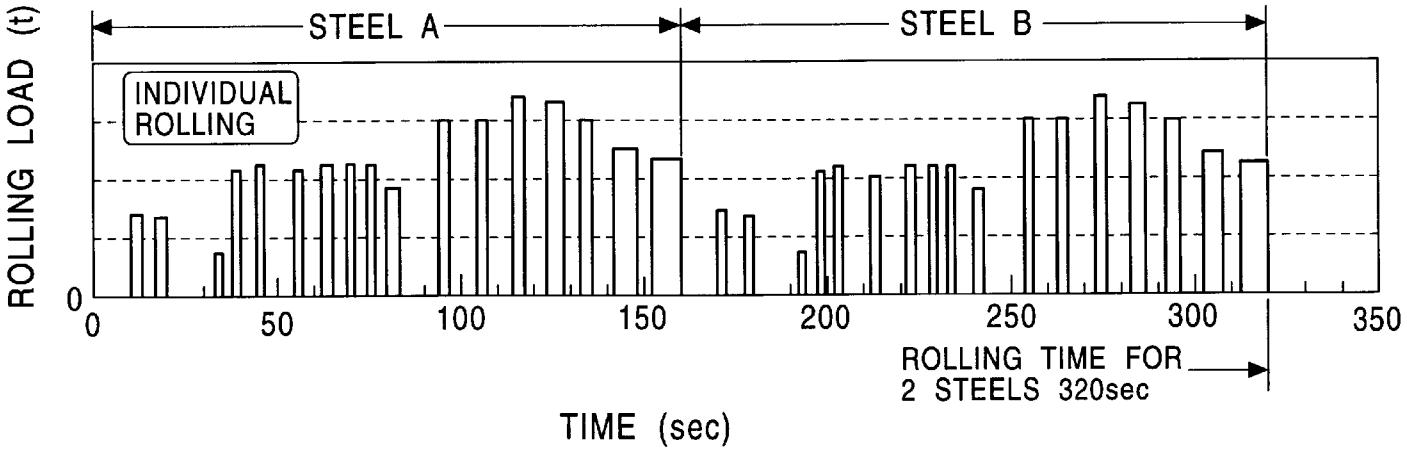
FIG. 2
Figure 3:
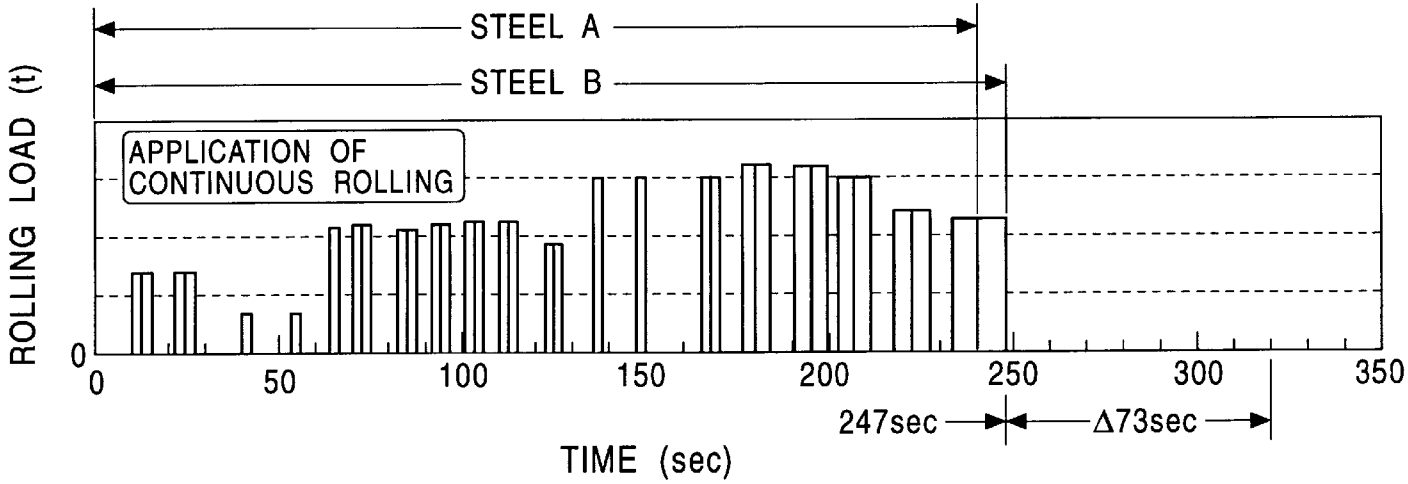
FIG. 3

FIG. 1 is view explaining a reverse rolling method as the example of the embodiment of the present invention, FIG. 2 is a graph showing a relationship between a rolling time and a rolling load when two steel strips are individually rolled one by one, and FIG. 3 is a graph showing a relationship between a rolling time and a rolling load when two steel strips are continuously rolled using the method of the present invention.

In FIG. 1, numeral 1 denotes a rolling mill, numeral 2 denotes inlet side transportation tables for transporting steel strips L and M at on the inlet side of the rolling mill 1, numeral 3 denotes outlet side transportation tables for transporting the steel strips L and M on the outlet side of the rolling mill 1, numeral 4 denotes a main controller for controlling speeds of the inlet side transportation tables 2 and the outlet side transportation tables 3, numeral 5 denotes inlet side interval measuring devices composed of CCD cameras or the like which are disposed at a plurality of positions above the inlet side transportation tables 2 along a transporting direction of the steel strips L and M to directly measure actual intervals between the steel strips L and M transported by the inlet side transportation tables 2, numeral 6 denotes outlet side interval measuring devices composed of CCD cameras or the like which are disposed at a plurality of positions above the outlet side transportation tables 3 along the transporting direction of the steel strips L and M to directly measure actual intervals between the steel strips L and M transported by the outlet side transportation tables 3, numeral 7 denotes an inlet side transportation table speed correcting means for outputting speed correction signals with respect to the inlet side transportation tables 2 to the main controller 4 based on a measured value of an interval between the steel strips obtained from the inlet side interval measuring devices 5, and numeral 8 denotes an outlet side transportation table speed correcting means for outputting speed correction signals with respect to the outlet side transportation tables 3 to the main controller 4 based on a measured value of an interval between the steel strips obtained from the outlet side interval measuring devices 6.

The main controller 4 includes a rolling speed setting means 9 for outputting a speed command value to the drive circuit (not shown) of the rolling mill 1 to set a rolling speed and to achieve the set speed, an inlet side transportation table speed setting means 10 for individually outputting speed command values to the drive circuits (not shown) of the respective inlet side transportation tables 2 in order to set speeds of the inlet side transportation tables 2 in consideration of a BACKWARD RATIO with respect to the rolling speed and to achieve the set speeds, and an outlet side transportation table speed setting means 11 for individually outputting speed command values to the drive circuits (not shown) of the respective outlet side transportation tables 3 to set speeds of the outlet side transportation tables 3 in consideration of a forward ratio with respect to the rolling speed and to achieve the set speeds.

Before the preceding steel strip L is rolled, that is, before the preceding steel strip L is caught by the rolling mill 1, the inlet side transportation table speed correcting means 7 outputs a speed correction signal to the inlet side transportation table speed setting means 10 for setting speeds, which have been selected based on position information of the succeeding steel strip M obtained by a tracking means (not shown), of the inlet side transportation tables 2 for transporting the succeeding steel strip M to thereby correct the speeds of the inlet side transportation tables 2 for transporting the succeeding steel strip M so as to increase or decrease the speeds so that measured values of an interval between the trailing end of the preceding steel strip L and the leading end of the succeeding steel strip M, which have been obtained by the inlet side interval measuring devices 5, are set to a first set value preset as an interval at which the preceding steel strip L does not come into collision with the succeeding steel strip M due to a reduction in speed which is caused when the preceding steel strip L is caught by the rolling mill 1.

Then, when it is detected by, for example, a load cell (not shown) or the like that the leading end of the preceding steel strip L has been caught by the rolling mill 1, the inlet side transportation table speed correcting means 7 outputs a speed correction signal to the inlet side transportation table speed setting means 10 for setting speeds, which have been selected based on position information of the succeeding steel strip M obtained by the tracking means, of the inlet side transportation tables 2 for transporting the succeeding steel strip M to thereby correct the speeds of the inlet side transportation tables 2 for transporting the succeeding steel strip M so as to increase or decrease the speeds so that measured values of an interval between the trailing end of the preceding steel strip L and the leading end of the succeeding steel strip M, which have been obtained by the inlet side interval measuring devices 5, are set to a second set value preset as an interval at which the succeeding steel strip M is caught by the rolling mill 1 at the same time at which the trailing end of the preceding steel strip L has passed through the rolling mill 1.

When it is detected that the succeeding steel strip M is being rolled by, for example, the load cell or the like, the outlet side transportation table speed correcting means 8 outputs a speed correction signal to the outlet side transportation table speed setting means 11 for setting speeds, which have been selected based on position information of the preceding steel strip L obtained by the tracking means, of the outlet side transportation tables 3 for transporting the preceding steel strip L to thereby control the speeds of the outlet transportation tables 3 for transporting the preceding steel strip L so that measured values of an interval between the trailing end of the preceding steel strip L and the leading end of the succeeding steel strip M, which have been obtained by the outlet side interval measuring devices 6, are set to an optimum interval in rolling in a next process, that is, in this embodiment, to a third set value preset as an interval (which is the same as the first set value) at which the preceding steel strip L does not come into collision with the succeeding steel strip M due to a reduction in speed which is caused when the succeeding steel strip is caught by the rolling mill 1 in reverse rolling.

It should be noted that after the trailing end of the succeeding steel strip M has passed through the rolling mill 1, rolling operation is shifted to the reverse rolling and interval control similar to the above interval control is carried out by interchanging the inlet side transportation table speed correcting means 7 and the outlet side transportation table speed correcting means 8.

As apparent from the above description, in the embodiment, direct measurement of an interval between the steel strips can prevent the accuracy of inter-strip control from being lowered by a measurement error. Moreover, before the preceding steel strip L is rolled and while it is being rolled as well as while the succeeding steel strip M is being rolled, the steel strips can be continuously rolled while minimizing an interval therebetween, which can dramatically improve a rolling efficiency.

It should be noted that, in the above embodiment, there is employed an example in which the inter-strip control is carried out by controlling a speed of the inlet side transportation tables 2 before the preceding steel strip L is rolled and while it is being rolled. However, the inter-strip control can be more accurately carried out by comprehensively controlling speeds of the inlet side transportation tables 2 and a speed of the rolling mill 1 before the preceding steel strip L is rolled and while it is being rolled and by comprehensively controlling speeds of the outlet side transportation tables 3 and a speed of the rolling mill 1 while the succeeding steel strip M is being rolled in place of the above method (shown by a broken line in FIG. 1). In this case, there is further provided a steel strip rolling speed correcting means for outputting a speed correction signal to the rolling speed setting means for setting a speed of the rolling mill to thereby correct the speed of the rolling mill 1 so as to increase or decrease the speed so that measured values of an interval between the trailing end of the preceding steel strip and the leading end of the succeeding steel strip, which have been obtained by the interval measuring devices on the inlet side of the rolling mill are set to a preset value after the leading end of the preceding steel strip has been caught by the rolling mill and so that measured values of the interval between the trailing end of the preceding steel strip and the leading end of the succeeding steel strip, which have been obtained by the interval measuring devices on the outlet side of the rolling mill are set to a preset value while the succeeding steel strip is being rolled.

FIG. 2 shows a relationship between a rolling time and a rolling load when two steel strips A and B are individually rolled one by one, and FIG. 3 shows a relationship between a rolling time and a rolling load when two steel strips A and B are continuously reverse rolled at the same time using the method of the present invention under the same rolling load condition as that in FIG. 2.

Application of the present invention can reduce a time necessary to decelerate and stop steel strips and a time necessary to revere the rolling mill. As apparent from FIGS. 2 and 3, a rolling time in the present invention is 247 sec, whereas a rolling time in the individual rolling is 320 sec, from which it is apparent that the method of the present invention can improve the rolling efficiency by 20% as compared with the individual rolling.

As apparent from the above description, in an invention according to claim 1, actual intervals between steel strips are directly measured and transportation speeds of a preceding steel strip and a succeeding steel strip are controlled separately from a speed of the rolling mill. This results in an effect of preventing an accuracy of inter-strip control from being lowered by an measurement error.

In an invention according to claim 2, the steel strips can be continuously rolled while minimizing an interval therebetween before a preceding steel strip L is rolled and while it is being rolled as well as while a succeeding steel strip M is being rolled in addition to the invention according to the invention. This results in an effect of dramatically improving the rolling efficiency.

In an invention of claim 3, speeds of the inlet side transportation tables and a speed of the rolling mill are comprehensively controlled before a preceding steel strip is rolled and while it is being rolled as well as speeds of the outlet side transportation tables and a speed of the rolling line are comprehensively controlled while a succeeding steel strip is being rolled. This results in an effect of carrying out the inter-strip control more accurately as compared with the invention of claim 2.

INDUSTRIAL APPLICABILITY

The present invention provides a technology which is effective in industries as a steel strip manufacturing method of continuously rolling a plurality of steel strips by controlling an interval between the steel strips, specifically, by directly measuring an actual interval between the steel strips and by controlling transportation speeds of a preceding steel strip and a succeeding steel strip and a speed and the like of a rolling mill.

What is claimed is:

1. A rolling method, characterized in that interval measuring means for directly measuring an actual interval between the trailing end of a preceding steel strip and the leading end of a succeeding steel strip are disposed on the inlet side and the outlet side of a rolling mill, respectively and transportation speeds of said preceding steel strip and said succeeding steel strip are controlled separately from a speed of said rolling mill based on measured values obtained by said interval measuring means on the inlet side and the outlet side.

2. A rolling method according to claim 1, characterized in that speeds of inlet side transportation tables for transporting the succeeding steel strip are controlled so that measured values, before said preceding steel strip is caught by said rolling mill, of an interval between the trailing end of said preceding steel strip and the leading end of said succeeding steel strip, which have been obtained by said inlet side interval measuring device, are set to a first set value preset as an interval at which said preceding steel strip does not come into collision with the succeeding steel strip due to a reduction in speed which is caused when said preceding steel strip is caught by said rolling mill, speeds of said inlet side transportation tables for transporting said succeeding steel strip are controlled separately from a speed of said rolling mill so that measured values, when said preceding steel strip is being rolled, of an interval between the trailing end of said preceding steel strip and the leading end of said succeeding steel strip, which have been obtained by said inlet side interval measuring device, are set to a second set value preset as an interval at which said succeeding steel strip is caught by said rolling mill at the same time at which the trailing end of said preceding steel strip has passed through said rolling mill, and speeds of outlet side transportation tables for transporting said preceding steel strip are controlled separately from a speed of said rolling mill so that measured values, when the succeeding steel strip is being rolled, of an interval between the trailing end of said preceding steel strip and the leading end of said succeeding steel strip, which have been obtained by said outlet side interval measuring device, is set to a third set value preset as an optimum interval in rolling in a next process.

3. A rolling method of disposing interval measuring means, which directly measures an actual interval between the trailing end of a preceding steel strip and the leading end of a succeeding steel strip, at an inlet side and an outlet side of a rolling mill, respectively and controlling transportation speeds of said preceding steel strip and said succeeding steel strip based on measured values which have been obtained by said interval measuring means at the inlet side and the outlet side, characterized in that speeds of inlet side transportation tables for transporting the succeeding steel strip are controlled so that measured values, before said preceding steel strip is caught by said rolling mill, of an interval between the trailing end of said preceding steel strip and the leading end of said succeeding steel strip, which have been obtained by said inlet side interval measuring device, are set to a first preset value as an interval at which said preceding steel strip does not come into collision with the succeeding steel strip due to a reduction in speed which is caused when said preceding steel strip is caught by said rolling mill, speeds of said inlet side transportation tables for transporting said succeeding steel strip are comprehensively controlled together with a speed of said rolling mill so that measured values, when said preceding steel strip is being rolled, of an interval between the trailing end of said preceding steel strip and the leading end of said succeeding steel strip, which have been obtained by said inlet side interval measuring device, are set to a second set value preset as an interval at which said succeeding steel strip is caught by said rolling mill at the same time at which the trailing end of said preceding steel strip has passed through said rolling mill, and speeds of outlet side transportation tables for transporting said preceding steel strip are comprehensively controlled together with a speed of said rolling mill so that measured values, when the succeeding steel strip is being rolled, of an interval between the trailing end of said preceding steel strip and the leading end of said succeeding steel strip, which have been obtained by said outlet side interval measuring device, is set to a third set value preset as an optimum interval in rolling in a next process.

4. A steel strip interval controller in an apparatus for continuously rolling a plurality of steel strips comprising the following means a)–h) of:

p1a) interval measuring means on the inlet side and the outlet side of a rolling mill for directly measuring an actual interval between the trailing end of a preceding steel strip and the leading end of a succeeding steel strip;

p1b) a steel strip transportation table speed setting means on the inlet side of said rolling mill;

p1c) a steel strip transportation table speed setting means on the outlet side of said rolling mill;

p1d) a rolling speed setting means in said rolling mill;

p1e) a steel strip transportation table speed correcting means on the inlet side of said rolling mill for outputting a speed correction signal to said inlet side transportation table speed setting means for setting speeds, which have been selected based on position information of said succeeding steel strip obtained by a tracking means, of transportation tables on the inlet side of said rolling mill for transporting said succeeding steel strip to thereby correct the speeds of said inlet side transportation tables for transporting said succeeding steel strip so as to increase or decrease the speeds so that measured values of an interval between the trailing end of the preceding steel strip and the leading end of the succeeding steel strip, which have been obtained by said interval measuring device on the inlet side of said rolling mill, are set to a preset value before said preceding steel strip is caught by said rolling mill;

p1f) a steel strip transportation table speed correcting means on the rolling line inlet side for outputting a speed correction signal to said inlet side transportation table speed setting means for setting speeds, which have been selected based on position information of said succeeding steel strip obtained by said tracking means, of said transportation tables on the inlet side of said rolling mill for transporting said succeeding steel strip to thereby correct the speeds of said inlet side transportation tables for transporting said succeeding steel strip so as to increase or decrease the speeds so that measured values of an interval between the trailing end of said preceding steel strip and the leading end of said succeeding steel strip, which have been obtained by said interval measuring device on the inlet side of said rolling mill, are set to a preset value after said preceding steel strip is caught by said rolling mill.

p1g) a steel strip transportation table speed correcting means on the outlet side of said rolling mill for outputting a speed correction signal to said outlet side transportation table speed setting means for setting speeds, which have been selected based on position information of said preceding steel strip obtained by said tracking means, of transportation tables on the outlet side of said rolling mill for transporting said preceding steel strip to thereby control the speeds of said outlet side transportation tables for transporting said preceding steel strip so that measured values of an interval between the trailing end of said preceding steel strip and the leading end of said succeeding steel strip, which have been obtained by said outlet side interval measuring device are set to a preset value;

p1h) a main controller including said steel strip transportation table speed setting means on the inlet side of said rolling mill, said steel strip transportation table speed setting means on the outlet side of said rolling mill, and said rolling speed setting means in said rolling mill.

5. A steel strip interval controller according to claim 4, further comprising, in said apparatus for continuously rolling a plurality of steel strips, a steel strip rolling speed correcting means in said rolling mill for outputting a speed correction signal to said rolling speed setting means for setting a speed of said rolling mill to thereby correct the speed of said rolling mill so as to increase or decrease the speed so that the measured values of the interval between the trailing end of said preceding steel strip and the leading end of said succeeding steel strip, which have always been obtained by said interval measuring device at the inlet side of said rolling mill, are set to a preset value after the leading end of said preceding steel strip has been caught by said rolling mill and so that measured values of an interval between the trailing end of said preceding steel strip and the leading end of said succeeding steel strip, which have been obtained by said interval measuring device on the outlet side of said rolling mill, are set to a preset value while said succeeding steel strip is being rolled.

* * * * *